US005342718A

United States Patent [19]

Nousho et al.

[11] Patent Number: 5,342,718

[45] Date of Patent: Aug. 30, 1994

[54] ELECTROPHOTOGRAPHIC PHOTOCONDUCTOR WITH OVERLAYER OF POLYOL-CURING POLYURETHANE RESIN

[75] Inventors: Shinji Nousho, Numazu; Mitsuru Seto, Yamakita; Junichiro Hashimoto, Susono; Takashi Rokutanzono, Numazu, all of Japan

[73] Assignee: RICOH Company, Ltd., Tokyo, Japan

[21] Appl. No.: 917,992

[22] Filed: Jul. 24, 1992

[30] Foreign Application Priority Data

Jul. 24, 1991 [JP] Japan ..... 3-184441

[51] Int. Cl.[5] ..... G03G 5/147

[52] U.S. Cl. ..... 430/58; 430/66; 430/67

[58] Field of Search ..... 430/56, 58, 59, 66, 430/67, 96

[56] References Cited

FOREIGN PATENT DOCUMENTS

| | | | |
|---|---|---|---|
| 53-089435 | 8/1978 | Japan | G03G 5/14 |
| 55-093156 | 7/1980 | Japan | G03G 5/14 |
| 57-030846 | 2/1982 | Japan | G03G 5/14 |
| 63-189486 | 8/1988 | Japan | C09J 3/16 |

*Primary Examiner*—Roland Martin

*Attorney, Agent, or Firm*—Oblon, Spivak, McClelland, Maier & Neustadt

[57] ABSTRACT

An electrophotographic photoconductor is composed of an electroconductive support, a photoconductive layer formed on the electroconductive support, and a protective layer formed on the photoconductive layer which is composed of a polyol curing-type urethane resin, and satisfies the condition of $\underline{b}/\underline{a} \leqq 0.2$, wherein $\underline{a}$ is the absorbance at 2920 $cm^{-}$ and $\underline{b}$ is the absorbance at 2260 $cm^{-1}$ in an IR spectrum of the protective layer.

19 Claims, No Drawings

ELECTROPHOTOGRAPHIC PHOTOCONDUCTOR WITH OVERLAYER OF POLYOL-CURING POLYURETHANE RESIN

BACKGROUND OF THE INVENTION

1. Field of the Invention

The present invention relates to an electrophotographic photoconductor comprising an electroconductive support, a photoconductive layer formed on the support, and a protective layer formed on the photoconductive layer, which comprises as the main component a polyol curing-type urethane resin.

2. Discussion of Background

Conventionally, a variety of electrophotographic photoconductors are known. For instance, there are known an electrophotographic photoconductor in which a photoconductive layer consisting essentially of selenium or a selenium alloy is formed on an electroconductive support; an electrophotographic photoconductor prepared by dispersing an inorganic photoconductive material, such as zinc oxide or cadmium oxide, in a binder agent and coating the dispersion on an electroconductive support; an electrophotographic photoconductor comprising a photoconductive layer which contains an organic photoconductive material such as a mixture of poly-N-vinylcarbazole and trinitrofluorenone, or an azo pigment; and an electrophotographic photoconductor comprising a photoconductive layer which contains amorphous silicon.

Recently a demand for an electrophotographic photoconductor having high reliability, capable of producing high quality images for a long period of time, is increasing. In the case of an electrophotographic photoconductor with an unprotected and exposed photoconductive layer, the photoconductive layer is gradually damaged by corona charges applied thereto in the course of a charging process. Furthermore, the photoconductive layer physically and chemically deteriorates in a copying process while it is brought into contact with other members of an electrophotographic copying apparatus. The above-mentioned problems are the main factors for shortening the life of the electrophotographic photoconductor.

To solve the above-mentioned problems., methods of providing a protective layer on the surface of an electrophotographic photoconductor are known. More specifically, there are disclosed a method of forming an organic film on the surface of a photoconductive layer of an electrophotographic photoconductor in Japanese Patent Publication 38-15446; a method of providing an inorganic oxide layer on the surface of a photoconductive layer in Japanese Patent Publication 43-14517; a method of successively overlaying an adhesive layer and an insulating layer on a photoconductive layer in Japanese Patent Publication 43-27591; and methods of laminating an amorphous silicon (a-Si) layer, an a-Si:N:H layer or an a-Si:O:H layer on a photoconductive layer by the plasma CVD or the photo CVD in Japanese Laid-Open Patent Applications 57-179859 and 59-58437.

However, when the above-mentioned protective layers have a resistivity of $10^{14}$ Ω.cm or more, which is considered to be too high in electrophotography, the residual potential of the photoconductor increases while in use, and the residual electric charges are gradually accumulated during the repetition of copying operation, which will hinder the practical operation of the photoconductor.

In order to cover up the above-mentioned shortcoming of the protective layer, there is proposed in Japanese Patent Publications 48-38427, 43-16198 and 49-10258, and U.S. Pat. No. 2,901,348 methods of forming a photoconductive protective layer on a photoconductive layer. In addition, there are disclosed a method of adding to a protective layer sensitizers such as dyes and charge transporting agents represented by Lewis acids, as in Japanese Patent Publication 44-834 and Japanese Laid-Open Patent Application 53-133444; and a method of controlling the resistivity of a protective layer by adding thereto finely-divided particles of metals or metallic oxides, as in Japanese Laid-Open Patent Application 53-3338.

According to the above-mentioned methods, however, light applied for image formation is partially absorbed in the protective layer while passing therethrough. As a result, the amount of the light which reaches the photoconductive layer is decreased and accordingly the photosensitivity of the photoconductor is decreased.

To eliminate the above-mentioned disadvantage, there is proposed in Japanese Laid-Open Patent Application 57-30846 a method of providing a protective layer which is made substantially transparent to visible light by dispersing therein finely-divided particles of a metallic oxide having an average particle diameter of 0.3 μm or less, which serve as a resistivity-controlling agent. In a photoconductor provided with the above-mentioned protective layer, the reduction in the photosensitivity can be minimized, the mechanical strength of the protective layer is increased, and the durability thereof is improved.

Especially when a polyol curing-type urethane resin is contained in a protective layer as a binder resin, the wear resistance of the obtained photoconductor can be significantly improved, and the life thereof can also be remarkably prolonged- However, the residual electric charges tend to be accumulated in this photoconductor during the repetition of copying operation, and the residual potential thereof increases, so that toner deposition on the background of images occurs. Specifically, under the conditions at low temperature and low humidity, the above-mentioned problem easily tends to occur, so that this photoconductor is not suitable for use in practice.

SUMMARY OF THE INVENTION

It is therefore an object of the present invention to provide an electrophotographic photoconductor having sufficiently high mechanical strength for use in practice, without the problem of toner deposition on the background of images, with a minimum residual potential which is neither increased cumulatively nor changed even when the environmental conditions under which this electrophotographic photoconductor is used are considerably changed, thus capable of providing high quality images with high reliability in a stable manner for an extended period of time.

The above-mentioned object of the present invention can be achieved by an electrophotographic photoconductor comprising an electroconductive support, a photoconductive layer formed on the electroconductive support, and a protective layer formed on the photoconductive layer comprising as the main component a polyol curing-type urethane resin prepared from polyol and polyisocyanate, which satisfies the condition of $b/a \leqq 0.2$, wherein a is the absorbance at 2920 $cm^{-1}$ and b is the absorbance at 2260 $cm^{-1}$ in an IR spectrum of the protective layer.

DETAILED DESCRIPTION OF THE PREFERRED EMBODIMENTS

A polyol curing-type urethane resin for use in the protective layer of the electrophotographic photoconductor according to the present invention is prepared from a polyol which is an active hydrogen component, and a polyisocyanate which is a curing agent.

As the polyol for use in the polyol curing-type urethane resin, polyether polyol such as polyalkylene oxide, polyester polyol such as aliphatic polyester having hydroxyl groups at the terminal thereof, acrylic polymer polyol such as hydroxymethacrylate copolymer, epoxy polyol such as epoxy resin, and fluorine-containing polyol can be employed.

Examples of the polyisocyanate for use in the polyol curing-type urethane resin are as follows: isocyanate compounds such as tolylene diisocyanate (TDI), diphenylmethane diisocyanate (MDI), xylene diisocyanate (XDI), hexamethylene diisocyanate (HDI), isophorone diisocyanate (IPDI), bis(isocyanatemethyl)cyclohexane (HXDI), and trimethylhexamethylene diisocyanate (TMDI); and polyisocyanates such as HDI-trimethylolpropane adduct, HDI-isocyanate, HDI-biuret, XDI-trimethylolpropane adduct, IPDI-trimethylolpropane adduct, and IPDI-isocyanurate.

In the present invention, the protective layer of the electrophotographic photoconductor comprising the polyol curing-type urethane resin satisfies the condition of $b/a \leqq 0.2$, wherein a is the absorbance at 2920 $cm^{-1}$ and b is the absorbance at 2260 $cm^{-1}$ in an IR spectrum of the protective layer.

The value of the above-mentioned absorption ratio b/a is determined depending not only on the amount ratio of polyol to polyisocyanate contained in the polyol curing-type urethane resin, but also on the environmental conditions and the time for air-drying of the protective layer, and the temperature and the time for heat-drying of the protective layer which is carried out after the air-drying.

In the present invention, the IR spectrum of the protective layer can be measured by a KBr tablet method using an infrared spectrometer. The above-mentioned a in the IR spectrum of the protective layer corresponds to the characteristic absorption peak at 2920 $cm^{-1}$ which is based on the C-H stretching vibrations of the methyl group in the polyol, and b in the IR spectrum of the protective layer is the characteristic absorption peak at 2260 $cm^{-1}$, which is based on the stretching vibrations of adjacent double bonds in the isocyanate group in the polyisocyanate. When the absorption ratio b/a is more than 0.2, the residual potential of the photoconductor under the conditions at room temperature and humidity is increased, and can be easily affected by the changes in the environmental conditions. Therefore, the obtained electrophotographic photoconductor comprising such a protective layer has the problem of causing toner deposition on the background of images obtained.

The specific resistivity of the protective layer is generally in the range of $10^{10}$ to $10^{13}$ Ω.cm, preferably in the range of $10^{11}$ to $10^{12}$ Ω.cm. This is because when the resistivity of the protective layer is less than $10^{10}$ Ω.cm, the sharpness of the images is lowered, while when the resistivity is more than $10^{13}$ Ω.cm, toner deposition on the background of images occurs. The larger the thickness of the protective layer, the more often the above-mentioned toner deposition tends to occur.

The polyol curing-type urethane resin for use in the protective layer of the electrophotographic photoconductor according to the present invention has a volume resistivity of about $10^{16}$ Ω.cm. When the above-mentioned polyol curing-type urethane resin is used in the protective layer for the photoconductor, it is preferable that the thickness of the protective layer be about 5000 Å, or that a resistivity-controlling agent be added to the above-mentioned polyol curing-type urethane resin so as to lower the volume resistivity thereof to about $10^{12}$ Ω.cm. In the latter case, the thickness of the protective layer can be optionally selected. When the thickness of the protective layer is 5 μm or more, the mechanical strength and the durability of the protective layer can be improved.

Examples of the resistivity-controlling agent are as follows: anionic, cationic, or nonionic organic electrolytes such as fatty acid salts, higher alcohols, sulfuric acid esters, fatty acid amines, quaternary ammonium salts, alkylpyridinium salts, polyoxyethylene alkyl ethers, polyoxyethylene alkyl esters, sorbitan alkyl esters, and imidazoline derivatives; metals such as Au, Ag, Cu, Ni, and Al; metallic oxides such as ZnO, $TiO_2$, $SnO_2$, $In_2O_3$, $Sb_2O_3$-containing $SnO_2$, and $In_2O_3$-containing $SnO_2$; metallic fluorides such as $MgF_2$, $CaF_2$, $BiF_2$, $AlF_3$, $SnF_2$, $SnF_4$, and $TiF_4$; organic titanium compounds such as tetraisopropyl titanate, tetranormalbutyl titanate, titanium acetyl acetonate, and titanium lactate ethyl ester; and the mixtures thereof.

The method of forming the protective layer of the electrophotographic photoconductor according to the present invention will now be explained.

The previously mentioned polyol is diluted with an appropriate solvent to obtain a solution. One or more of the above-mentioned resistivity-controlling agents are added to the above solution in such a manner that a protective layer has a volume resistivity of about $10^{12}$ Ω.cm. In the case where the resistivity-controlling agent does not have compatibility with the polyol, the mixture thereof is dispersed in a ball mill when necessary.

Then, polyisocyanate is added to the above prepared mixture in such a manner that when c is the number of moles of OH groups in the polyol, and d is the number of moles of NCO groups in the polyisocyanate, the condition of $d/c \leqq 0.8$ is satisfied. The thus prepared liquid for forming the protective layer is coated on the photoconductive layer, dried, and cured, so that a protective layer is formed on the photoconductive layer.

The protective layer of the electrophotographic photoconductor according to the present invention can be formed by the following steps:

(1) Mixing polyol and polyisocyanate to obtain a mixture.

(2) Adding a solvent to the mixture prepared in step (1) to prepare a coating liquid for the formation of the protective layer with the adjustment of the viscosity thereof.

(3) Coating the coating liquid for forming the protective layer prepared in Step (2) on the photoconductive layer by spray coating or dipping.

(4) Vaporizing the solvent contained in the coating liquid so as to dry it to the touch.

(5) Drying the coating liquid, for example, by the application of hot air.
(6) Cooling.
(7) Allowing the thus formed protective layer to stand in the dark.

In the present invention, when the conditions for forming the protective layer are fixed as mentioned above, the smaller the amount of the polyisocyanate to be contained in the coating liquid for forming the protective layer, the smaller the value of b/a. However, when the value of b/a is made smaller by decreasing the amount of the polyisocyanate, the mechanical strength of the protective layer is lowered. Therefore, in order to obtain the protective layer having a satisfactory mechanical strength, it is preferable that the condition of $d/c \geqq 0.8$, more preferably $d/c \geqq 1$, be satisfied, wherein c is the number of moles of the OH groups in the polyol, and d is the number of moles of the NCO groups in the polyisocyanate.

In order to decrease the value of b/a with maintaining the mechanical strength of the protective layer by adding a sufficient amount of the polyisocyanate to the protective layer, a specific condition has to be satisfied in the course of the above-mentioned steps (1) to (7). Such a specific condition will now be explained.

When at least one of the following conditions is satisfied, a protective layer comprising the polyol curing-type urethane resin, which satisfies the conditions of $b/a \leqq 0.2$ and $d/c \geqq 0.8$, can be obtained.

(i) When the coating liquid for forming the protective layer is coated on the photoconductive layer (Step 3) and the solvent is vaporized so as to dry the above liquid to the touch (Step 4), the above-mentioned processes are carried out in an atmosphere in which the amount of steam contained in 1 kg of dry air is 0.012 kg or more.
(ii) After Step 4, the protective layer is allowed to stand for 24 hours in an atmosphere in which the amount of steam contained in 1 kg of dry air is 0.020 kg or more.
(iii) After Step 4, the protective layer is dried by the application of heat thereto for 1 hour at the temperature of or more than 1.3 times the glass transition point of the polyol.
(iv) After Step 4, the protective layer is dried by the application of heat thereto for 1 hour at the temperature of or more than the glass transition point of the polyol, and then allowed to stand for 3 days in an atmosphere in which the amount of steam contained in 1 kg of dry air is 0.016 kg or more.

Furthermore, when the protective layer of the electrophotographic photoconductor according to the present invention comprises polyisocyanate having an amide bond, it is preferable that the condition of $f/3 \geqq 0.9$ be satisfied, wherein e is the absorption peak of a methyl group at 1450 $cm^{-1}$ and f is the absorption peak of an amide group at 1520 $cm_{-1}$ in an IR spectrum of the protective layer.

The above-mentioned e is the characteristic absorption peak at 1450 $cm^{-1}$, which is based on the C-H deformation vibrations of the methyl group, and f is the characteristic absorption peak at 1520 $cm^{-1}$ which is based on the N-H deformation vibrations of the amide group. When the condition of $f/e \geqq 0.9$ is satisfied, the mechanical strength of the protective layer can be improved, and the life span of the electrophotographic photoconductor comprising such a protective layer can sufficiently be prolonged.

As the polyisocyanate having the amide bond, HDI-trimethylolpropane adduct, IPDI-trimethylolpropane adduct, and HDI-biuret can be employed.

The value of the above-mentioned f/e can be adjusted by the amount of the polyisocyanate compound to be added to the the protective layer. In order to satisfy the condition of $f/e \geqq 0.9$, it is preferable that the condition of $d/c \geqq 1$ be satisfied, wherein c is the number of moles of the OH groups in the polyol, and d is the number of moles of the NCO groups in the polyisocyanate.

In the present invention, the conventional methods can be employed for forming the photoconductive layer and the electroconductive support of the electrophotographic photoconductor.

As the materials for the photoconductive layer of the electrophotographic photoconductor according to the present invention, Se or Se-based alloys such as Se-Te and $As_2Se_3$; resins in which particles of II-VI group compounds such as ZnO, CdS, and CdSe are dispersed; organic photoconductive materials such as polyvinyl carbazole and anthracene; and amorphous Si, can be employed.

For forming the photoconductive layer, any methods such as the deposition method, the sputtering method, or the coating method, can be optionally selected, depending on the materials for use in the photoconductive layer.

The structure of the photoconductive layer is not specifically limited. It may consist of a single layer or laminated layers which are composed of a charge generation layer comprising as the main component the above-mentioned material for use in the photoconductive layer, and a charge transport layer comprising as the main component a donor or an acceptor. It is preferable that the thickness of the single photoconductive layer be 3 to 100 μm, the thickness of the charge generation layer and the thickness of the charge transport layer of the laminated photoconductive layer be respectively 0.05 to 3 μm, and 3 to 100 μm.

Furthermore, an adhesive layer for improving the adhesion between the protective layer and the photoconductive layer, an electric barrier layer for preventing the charge injection, or a solvent resistance layer for preventing a solvent contained in the liquid for forming the protective layer from impairing an organic photoconductive layer, can be inserted between the protective layer and the photoconductive layer.

As the materials for the electroconductive support of the electrophotographic photoconductor according to the present invention, metals such as Al, Ni, Fe, Cu, and Au and alloys thereof; insulating materials such as plastics, for example, polyester, polycarbonate, and polyimide, and glass, which are coated by a thin film of a metal such as Al, Ag or Au or a metallic oxide such as $In_2O_3$ or $SnO_2$; and a sheet of paper treated so as to be electroconductive can be employed.

There is no limitation to the shape of the electroconductive support. Generally, it can be shaped in a plate, a drum or a belt.

In the case where a belt-shaped electroconductive support is employed for the electrophotographic photoconductor of the present invention, it is preferable that the relation between the number of moles c of the OH groups in the polyol and the number of moles d of the NCO groups in the polyisocyanate which are contained in the polyol curing-type urethane resin for use in the protective layer satisfy the condition of $0.8 \leqq d/c \leqq 3$. it is because when d/c is more than 3, the belt-shaped electrophotographic photoconductor is stretched and distorted in the repeated copying operations, and the protective layer thereof is cracked.

Other features of this invention will become apparent in the course of the following description of exemplary embodiments, which are given for illustration of the invention and are not intended to be limiting thereof.

EXAMPLE 1

Formation of Photoconductive Layer

An aluminum drum support with a width of 120 mm, a length of 480 mm, and a thickness of 4 mm was set in a vacuum metallizer. An $As_2Se_3$ alloy was placed in a boat in the above vacuum metallizer and vacuum-deposited on the support under the following conditions, so that a photoconductive layer with a thickness of 60 μm was formed on the support:

Degree of vacuum: $3\times10^{-6}$ Torr
Temperature of the support: 200° C.
Temperature of the boat: 450° C.

Formation of Electric Barrier Layer

A silicone resin A "AY42-440" (Trademark), made by Dow Corning Toray Silicone Co., Ltd. and a silicone resin B "AY42-441" (Trademark), made by Dow Corning Toray Silicone Co., Ltd. were mixed at a mixing ratio by weight of 1:1.

The above silicone resin A comprises as the main components:

a) alkoxyl-group-containing polysiloxane;
b) hydroxyl-group-containing polysiloxane; and
c) an organic silicon compound having at least one of an amino group, an imino group, or a nitril group, which is bonded to a carbon atom, and a silicon atom to which 2 to 3 alkoxyl groups are bonded.

The silicone resin B comprises as the main components the same components as contained in the silicone resin A, but the amount ratio of the components a), b), and c) contained in the silicone resin B is different from that in the silicone resin A.

The above prepared mixture of the silicone resin A and the silicone resin B was dissolved in ligroin to obtain a coating liquid for an electric barrier layer. The thus obtained coating liquid was coated on the previously formed photoconductive layer, and dried at 120° C. for 1 hour, so that an electric barrier layer with a thickness of 0.1 μm was formed on the photoconductive layer.

Formation of Protective Layer

A mixture of 30 parts by weight of a mixed solvent of 2-ethoxyethyl acetate and methyl isobutyl ketone containing 20 wt. % of a styrene-methyl methacrylate-2-ethylhexylmethacrylate copolymer (hereinafter referred to as St-MMA-2-EHMA copolymer, the amount ratio of OH: 3.92 wt. %, glass transition point: 118° C.) and 20 parts by weight of $SnO_2$ serving as a resistivity-controlling agent was dispersed in a ball mill for 120 hours to obtain an original coating liquid for a protective layer.

To the thus obtained original coating liquid, isophorone diisocyanate (IPDI) serving as a curing agent (the amount ratio of isocyanate: 37.5 wt. %) and St-MMA-2-EHMA copolymer (solid content: 20 wt. %, glass transition point: 118° C.) were added in such a manner that the amount ratio by weight of $SnO_2$ to a resin (a combination of the solid content of the St-MMA-2-EHMA copolymer and an active ingredient in the curing agent) was 6:4, and the amount ratio of the number of moles $\underline{d}$ of NCO groups to the number of moles $\underline{c}$ of OH groups, that is, $\underline{d}/\underline{c}$ was 0.5, so that a coating liquid for a protective layer was obtained.

The above prepared liquid was coated on the previously formed electric barrier layer by spray coating in an atmosphere in which the amount of steam contained in 1 kg of dry air was 0.016 kg, and dried for 10 minutes so as to dry the coating liquid to the touch. Then the thus dried liquid was allowed to stand for 24 hours in an atmosphere in which the amount of steam contained in 1 kg of dry air was 0.007 kg, and successively allowed to stand for 3 days in an atmosphere in which the amount of steam contained in 1 kg of dry air was 0.007 kg, so that a protective layer with a thickness of 5 μm was formed on the electric barrier layer.

Thus, an electrophotographic photoconductor No. 1 of the present invention was obtained.

EXAMPLES 2 TO 15 AND COMPARATIVE EXAMPLES 1 TO 14

The procedure for preparing the electrophotographic photoconductor in Example 1 was repeated except that the composition of the coating liquid for the protective layer and the environmental conditions for forming the protective layer were changed to those as shown in Tables 1 and 2, whereby electrophotographic photoconductor Nos. 2 to 15 of the present invention and comparative electrophotographic photoconductor Nos. 1 to 14 were obtained.

In the course of forming the protective layers in Examples 5, 6, 9, 10, 11, 12, 14, and 15, and Comparative Examples 5, 6, 7, 10, 11, 12, 13, and 14, the coating liquid for each protective layer was dried under the application of heat thereto for 1 hour at each temperature which is shown in Tables 1 and 2, after the coating liquid was dried to the touch and allowed to stand for 24 hours.

TABLE 1

| | Composition of Coating Liquid for Protective Layer | | | Environmental Conditions for Forming Protective Layer | | | |
|---|---|---|---|---|---|---|---|
| Example No. | Curing Agent | Weight Ratio $SnO_2$/Resin | d/c | Condition for Coating (***) | Condition for Standing after Coating (***) | Drying Temperature (°C.) | Condition for Standing after Drying (***) |
| Ex. 1 | IPDI | 6/4 | 0.5 | 0.016 | 0.007 | not dried | 0.007 |
| Ex. 2 | IPDI | 6/4 | 0.5 | 0.007 | 0.024 | not dried | 0.007 |
| Ex. 3 | IPDI | 6/4 | 1.0 | 0.013 | 0.007 | not dried | 0.007 |
| Ex. 4 | IPDI | 6/4 | 1.0 | 0.007 | 0.024 | not dried | 0.007 |
| Ex. 5 | IPDI | 6/4 | 1.0 | 0.007 | 0.007 | 150 | 0.007 |
| Ex. 6 | IPDI | 6/4 | 1.0 | 0.007 | 0.007 | 110 | 0.020 |
| Ex. 7 | HDI bluret (*) | 6/4 | 1.5 | 0.024 | 0.007 | not dried | 0.007 |
| Ex. 8 | HDI bluret (*) | 6/4 | 1.5 | 0.007 | 0.058 | not dried | 0.007 |
| Ex. 9 | HDI bluret (*) | 6/4 | 1.5 | 0.007 | 0.007 | 170 | 0.007 |

TABLE 1-continued

| Example No. | Composition of Coating Liquid for Protective Layer: Curing Agent | Weight Ratio $SnO_2$/Resin | d/c | Environmental Conditions for Forming Protective Layer: Condition for Coating (***) | Condition for Standing after Coating (***) | Drying Temperature (°C.) | Condition for Standing after Drying (***) |
|---|---|---|---|---|---|---|---|
| Ex. 10 | HDI bluret (*) | 6/4 | 1.5 | 0.007 | 0.007 | 110 | 0.032 |
| Ex. 11 | HDI-TMP adduct (**) | 6/4 | 0.5 | 0.018 | 0.007 | 110 | 0.007 |
| Ex. 12 | HDI-TMP adduct (**) | 6/4 | 1.0 | 0.018 | 0.007 | 110 | 0.007 |
| Ex. 13 | HDI-TMP adduct (**) | 6/4 | 1.5 | 0.018 | 0.032 | not dried | 0.007 |
| Ex. 14 | HDI-TMP adduct (**) | 6/4 | 2.0 | 0.007 | 0.007 | 170 | 0.032 |
| Ex. 15 | HDI-TMP adduct (**) | 6/4 | 2.5 | 0.007 | 0.058 | 110 | 0.007 |

TABLE 2

| Comp. Ex. No. | Composition of Coating Liquid for Protective Layer: Curing Agent | Weight Ratio $SnO_2$/Resin | d/c | Environmental Conditions for Forming Protective Layer: Condition for Coating (***) | Condition for Standing after Coating (***) | Drying Temperature (°C.) | Condition for Standing after Drying (***) |
|---|---|---|---|---|---|---|---|
| Comp. Ex. 1 | IPDI | 6/4 | 0.5 | 0.007 | 0.007 | not dried | 0.007 |
| Comp. Ex. 2 | IPDI | 6/4 | 1.0 | 0.007 | 0.007 | not dried | 0.007 |
| Comp. Ex. 3 | IPDI | 6/4 | 1.0 | 0.010 | 0.007 | not dried | 0.007 |
| Comp. Ex. 4 | IPDI | 6/4 | 1.0 | 0.007 | 0.016 | not dried | 0.007 |
| Comp. Ex. 5 | IPDI | 6/4 | 1.0 | 0.007 | 0.007 | 90 | 0.007 |
| Comp. Ex. 6 | IPDI | 6/4 | 1.0 | 0.007 | 0.007 | 80 | 0.020 |
| Comp. Ex. 7 | IPDI | 6/4 | 1.0 | 0.007 | 0.007 | 110 | 0.010 |
| Comp. Ex. 8 | HDI bluret (*) | 6/4 | 1.5 | 0.010 | 0.007 | not dried | 0.007 |
| Comp. Ex. 9 | HDI bluret (*) | 6/4 | 1.5 | 0.007 | 0.016 | not dried | 0.007 |
| Comp. Ex. 10 | HDI bluret (*) | 6/4 | 1.5 | 0.007 | 0.007 | 100 | 0.007 |
| Comp. Ex. 11 | HDI bluret (*) | 6/4 | 1.5 | 0.007 | 0.007 | 90 | 0.014 |
| Comp. Ex. 12 | HDI-TMP adduct (**) | 6/4 | 0.5 | 0.007 | 0.007 | 80 | 0.007 |
| Comp. Ex. 13 | HDI-TMP adduct (**) | 6/4 | 1.5 | 0.007 | 0.007 | 80 | 0.007 |
| Comp. Ex. 14 | HDI-TMP adduct (**) | 6/4 | 2.5 | 0.007 | 0.007 | 80 | 0.007 |

Notes)
(*): DHI bluret is a hexamethylene diisocyanate bluret (the amount ratio of isocyanate: 22.9 wt. %).
(**): NDI-TMP adduct is a trimethylolpropane adduct of hexamethylene diisocyanate (the amount ratio of isocyanate: 12.9 wt.%).
(***): Environmental conditions are indicated by the amount (kg) of steam contained in 1 kg of dry air at 20° C., 50% RH.

Each of the thus obtained electrophotographic photoconductor Nos. 1 to 15 of the present invention and comparative electrophotographic photoconductor Nos. 1 to 14 was incorporated in a commercially available copying machine "FT7160" (Trademark), made by Ricoh Company, Ltd. After the photoconductor was charged and exposed to light, the residual potential of the exposed area was measured under each of the three different conditions at 10° C. 15% RH, 20° C. 50% RH, and 30° C. 90% RH.

Furthermore, each of the above electrophotographic photoconductors was caused to wear away using a photoconductor wear resistance tester with the application of a load corresponding to the making of 100,000 copies, and the wear resistance of each photoconductor was evaluated.

The results of the above two tests are shown in Tables 3 and 4.

Tables 3 and 4 also show the ratio (b/a and f/e) of the absorption peaks in an IR spectrum of the protective layer of each of the above obtained electrophotographic photoconductors.

TABLE 3

| Example No. | Ratio of Absorption Peaks in IR Spectrum: b/a | f/e (*) | Residual Potential (v) Environmental Conditions: 10° C. 15%RH | 20° C. 50%RH | 30° C. 90%RH | Difference (10° C., 15%RH) − (30° C., 90%RH) | Wear Resistance Thickness of Film Lost After Wear Resistance Test (μm) |
|---|---|---|---|---|---|---|---|
| Ex. 1 | 0.11 | — | 90 | 70 | 55 | 35 | 0.4 |
| Ex. 2 | 0.05 | — | 85 | 75 | 65 | 20 | 0.2 |

TABLE 3-continued

| Example No. | Ratio of Absorption Peaks in IR Spectrum b/a | f/e (*) | Residual Potential (v) Environmental Conditions 10° C. 15%RH | 20° C. 50%RH | 30° C. 90%RH | Difference (10° C., 15%RH) − (30° C., 90%RH) | Wear Resistance Thickness of Film Lost After Wear Resistance Test (μm) |
|---|---|---|---|---|---|---|---|
| Ex. 3 | 0.18 | — | 105 | 90 | 65 | 40 | 0.1 |
| Ex. 4 | 0.09 | — | 95 | 80 | 70 | 25 | 0.0 |
| Ex. 5 | 0.13 | — | 100 | 90 | 70 | 30 | 0.0 |
| Ex. 6 | 0.13 | — | 100 | 95 | 70 | 30 | 0.1 |
| Ex. 7 | 0.06 | 1.53 | 95 | 85 | 80 | 15 | 0.0 |
| Ex. 8 | 0.00 | 1.47 | 85 | 80 | 80 | 5 | 0.0 |
| Ex. 9 | 0.00 | 1.48 | 80 | 80 | 80 | 0 | 0.0 |
| Ex. 10 | 0.00 | 1.54 | 85 | 80 | 85 | 0 | 0.0 |
| Ex. 11 | 0.00 | 0.92 | 80 | 75 | 75 | 5 | 0.2 |
| Ex. 12 | 0.00 | 1.25 | 75 | 75 | 75 | 0 | 0.1 |
| Ex. 13 | 0.00 | 1.53 | 75 | 75 | 75 | 0 | 0.0 |
| Ex. 14 | 0.00 | 1.70 | 80 | 80 | 75 | 0 | 0.0 |
| Ex. 15 | 0.00 | 1.98 | 90 | 85 | 70 | 15 | 0.0 |

TABLE 4

| Example No. | Ratio of Absorption Peaks in IR Spectrum b/a | f/e (*) | Residual Potential (v) Environmental Conditions 10° C. 15%RH | 20° C. 50%RH | 30° C. 90%RH | Difference (10° C., 15%RH) − (30° C., 90%RH) | Wear Resistance Thickness of Film Lost After Wear Resistance Test (μm) |
|---|---|---|---|---|---|---|---|
| Comp. Ex. 1 | 0.82 | — | 145 | 105 | 80 | 65 | 3.3 |
| Comp. Ex. 2 | 1.03 | — | 195 | 140 | 60 | 135 | 2.2 |
| Comp. Ex. 3 | 0.56 | — | 160 | 130 | 75 | 85 | 1.7 |
| Comp. Ex. 4 | 0.27 | — | 170 | 135 | 80 | 85 | 0.4 |
| Comp. Ex. 5 | 0.51 | — | 210 | 145 | 65 | 145 | 1.3 |
| Comp. Ex. 6 | 0.28 | — | 160 | 120 | 80 | 80 | 0.5 |
| Comp. Ex. 7 | 0.36 | — | 195 | 135 | 75 | 120 | 1.4 |
| Comp. Ex. 8 | 0.52 | 1.51 | 230 | 155 | 60 | 170 | 0.8 |
| Comp. Ex. 9 | 0.48 | 1.51 | 240 | 150 | 50 | 190 | 1.2 |
| Comp. Ex. 10 | 0.60 | 1.46 | 265 | 165 | 50 | 214 | 0.9 |
| Comp. Ex. 11 | 0.42 | 1.62 | 220 | 150 | 70 | 150 | 0.6 |
| Comp. Ex. 12 | 0.55 | 0.87 | 160 | 100 | 60 | 100 | 2.4 |
| Comp. Ex. 13 | 0.82 | 1.24 | 240 | 165 | 50 | 190 | 1.0 |
| Comp. Ex. 14 | 1.17 | 1.93 | 320 | 205 | 45 | 275 | 0.3 |

Note)
(*): The ratio f/e of the abosrption peaks in IR spectrum was measured only when the polyisocyanate having an amide bond was employed as the curing agent.

As is apparent from Tables 2 and 4, in the case of the comparative electrophotographic photoconductors, the larger the value of d/c, the larger the residual potential of the photoconductor under the conditions at room temperature and humidity, and the more easily the residual potential is affected by the changes in the environmental conditions. Furthermore, the larger the amount of the NCO groups remaining in the protective layer, namely, the value of $NCO/CH_3$, the more easily the residual potential is affected by the changes in the environmental conditions.

The smaller the value of d/c, the lower the mechanical strength of the protective layer of the comparative electrophotographic photoconductor. Therefore, when the value of d/c is made smaller in order to reduce the residual potential, the mechanical strength of the protective layer becomes sufficiently high for use in practice.

On the other hand, as is apparent from Tables 1 and 3, the mechanical strength of the protective layer of the electrophotographic photoconductors of the present invention is not largely affected by the value of d/c, and all of the above electrophotographic photoconductors of the present invention have remarkably improved mechanical strength. Furthermore, the build-up of the residual potential under the conditions at room temperature and humidity, and changes in the residual potential in accordance with the changes in the environmental conditions are very slight, because the NCO groups scarcely remain in the protective layer.

When the polyisocyanate having the amide bond is employed as the curing agent in the protective layer, not only the handling of the polyisocyanate becomes easier, but also the residual potential decreases, the changes in residual potential in accordance with the changes in the environmental conditions is well controlled, and the mechanical strength of the protective layer is remarkably improved.

The electrophotographic photoconductor of the present invention has high mechanical strength and does not accumulate the residual potential, so that it can yield, for a long period of time, high quality images without having white stripes or black stripes thereon, and toner deposition on the background thereof. Moreover, the present invention can provide the stable electrophotographic photoconductor whose residual potential is not affected by the changes in the environmental conditions.

What is claimed is:

1. An electrophotographic photoconductor comprising:

(1) an electroconductive support, (2) a photoconductive layer formed on said electroconductive support, and (3) a protective layer formed on said photoconductive layer comprising a polyol-curing urethane resin, which satisfies the condition of $b/a \leqq 0.2$, wherein a is the absorbance at 2920 $cm^{-1}$ and b is the absorbance at 2260 $cm^{-1}$ in an IR spectrum of said protective layer.

2. The electrophotographic photoconductor as claimed in claim 1, wherein said polyol-curing urethane resin is prepared from polyol and polyisocyanate.

3. The electrophotographic photoconductor as claimed in claim 2, wherein said polyol-curing urethane resin satisfies the condition of $d/c \geqq 0.8$, wherein c is the number of moles of OH groups in said polyol, and d is the number of moles of NCO groups in said polyisocyanate.

4. The electrophotographic photoconductor as claimed in claim 3, wherein said polyol-curing urethane resin satisfies the condition of $d/c \geqq 1$.

5. The electrophotographic photoconductor as claimed in claim 2, wherein said polyisocyanate has an amide bond, and said polyol-curing urethane resin satisfies the condition of $f/e \geqq 0.9$, wherein e is the absorbance at 1450 $cm^{-1}$, and f is the absorbance at 1520 $cm^{31\ 1}$ in an IR spectrum of said protective layer.

6. The electrophotographic photoconductor as claimed in claim 2, wherein said polyol for use in said polyol-curing urethane resin is selected from the group consisting of polyether polyol, polyester polyol, acrylic polymer polyol, epoxy polyol, and fluorine-containing polyol.

7. The electrophotographic photoconductor as claimed in claim 2, wherein said polyisocyanate for use in said polyol-curing urethane resin is selected from the group consisting of tolylene diisocyanate (TDI), diphenylmethane diisocyanate (MDI), xylene diisocyanate (XDI), hexamethylene diisocyanate (HDI), isophorone diisocyanate (IPDI), bis(isocyanatemethyl)cyclohexane (HXDI), trimethylhexamethylene diisocyanate (TMDI), HDI-trimethylolpropane adduct, HDI-isocyanate, HDI-biuret, XDI-trimethylolpropane adduct, IPDI-trimethylolpropane adduct, and IPDI-isocyanurate.

8. The electrophotographic photoconductor as claimed in claim 1, wherein said protective layer has a specific resistivity in the range of $10^{10}$ Ω.cm to $10^{13}$ Ω.cm.

9. The electrophotographic photoconductor as claimed in claim 1, wherein said protective layer has a thickness of 5000 Å.

10. The electrophotographic photoconductor as claimed in claim 1, wherein said protective layer further comprises a resistivity-controlling agent.

11. The electrophotographic photoconductor as claimed in claim 10, wherein said protective layer has a thickness of 5 μm or more.

12. The electrophotographic photoconductor as claimed in claim 1, wherein said photoconductive layer has a thickness of 3 to 100 μm .

13. The electrophotographic photoconductor as claimed in claim 1, wherein said photoconductive layer comprises a charge generation layer and a charge transport layer.

14. The electrophotographic photoconductor as claimed in claim 13, wherein said charge generation layer has a thickness of 0.05 to 3 μm .

15. The electrophotographic photoconductor as claimed in claim 13, wherein said charge transport layer has a thickness of 3 to 100 μm .

16. The electrophotographic photoconductor as claimed in claim 1, further comprising an adhesive layer interposed between said protective layer and said photoconductive layer.

17. The electrophotographic photoconductor as claimed in claim 1, further comprising an electric barrier layer interposed between said protective layer and said photoconductive layer.

18. The electrophotographic photoconductor as claimed in claim 1, further comprising a solvent resistance layer interposed between said protective layer and said photoconductive layer.

19. The electrophotographic photoconductor as claimed in claim 2, wherein said electroconductive support is in the shape of a belt, and said polyol-curing urethane resin contained in said protective layer satisfies the condition of $0.8 \leqq d/c \leqq 3$, wherein c is the number of moles of OH groups in said polyol, and d is the number of moles of NCO groups in said polyisocyanate.

* * * * *

UNITED STATES PATENT AND TRADEMARK OFFICE

CERTIFICATE OF CORRECTION

PATENT NO. : 5,342,718

DATED : August 30, 1994

INVENTOR(S) : Shinji NOUSHO ET AL

It is certified that error appears in the above-identified patent and that said Letters Patent is hereby corrected as shown below:

Item [57]

In the Abstract, line 7, delete "2920 cm-" and insert -- 2920 $cm^{1}$- --.

Column 2, line 40, delete "prolonged-" and insert -- prolonged.--.

Column 4, line 51, delete "d/c ≤" and insert --d/c ≥ --.

Column 7, Table 1, delete "d/c" and insert --d/c--.

Col. 7, at location (Ex. 7, 8 & 9), Table 1, delete "bluret" and insert --biuret --.

Column 9, Table 2, delete "d/c" and insert --d/c--.

Column 9, Table 2, delete "bluret" and insert --biuret--.
(at Location (Comp. Ex. 8, 9, 10 & 11)

Column 9, in the Notes under Table 2, delete "DHI bluret" and insert --HDI biuret--; and delete "bluret" (second occurrence) and insert --biuret--.

UNITED STATES PATENT AND TRADEMARK OFFICE

CERTIFICATE OF CORRECTION

PATENT NO. : 5,342,718

DATED : August 30, 1994

INVENTOR(S) : Shinji NOUSHO ET AL

It is certified that error appears in the above-identified patent and that said Letters Patent is hereby corrected as shown below:

Column 9, in the Notes under Table 2, delete "NDI-TMP" and insert --HDI-TMP--.

Column 9, Table 3, delete "b/a" and "f/e" and insert therefor --b/a and f/e--.

Column 11, Table 4, delete "b/a" and "f/e" and insert therefor --b/a and f/e--.

Column 12, Table 4, Comp. Ex. 10, delete "214" and insert --215--.

Column 13, line 46, delete "$cm^{31\ 1}$" and insert --$cm^{-1}$--.

Signed and Sealed this

Eighteenth Day of June, 1996

*Attest:*

*Attesting Officer*

BRUCE LEHMAN

*Commissioner of Patents and Trademarks*